United States Patent [19]

Romer

[11] Patent Number: 4,662,704

[45] Date of Patent: May 5, 1987

[54] COAXIAL CABLE CONNECTION TO A TERMINAL STRIP

[75] Inventor: Michael Romer, Fellbach, Fed. Rep. of Germany

[73] Assignee: International Standard Electric Corporation, New York, N.Y.

[21] Appl. No.: 859,578

[22] Filed: May 5, 1986

[30] Foreign Application Priority Data

May 8, 1985 [DE] Fed. Rep. of Germany ..... 3516508

[51] Int. Cl.[4] ..... H01R 17/18

[52] U.S. Cl. ..... 339/177 R; 339/59 M; 339/198 R

[58] Field of Search ..... 339/177, 103, 59 R, 339/59 M, 104, 213 R, 143 R, 125 R, 126 R, 126 J, 198 R; 174/135

[56] References Cited

U.S. PATENT DOCUMENTS

| | | | |
|---|---|---|---|
| 2,798,113 | 7/1957 | Koller et al. | 339/177 E |
| 2,887,667 | 5/1959 | Wolfe et al. | 339/177 E |
| 4,169,650 | 10/1979 | Schweizer | 339/177 R |
| 4,183,603 | 1/1980 | Donarummo | 339/103 R |
| 4,221,449 | 9/1980 | Shugart, Jr. | 339/103 R |
| 4,606,120 | 8/1986 | McAndrew | 174/135 |

FOREIGN PATENT DOCUMENTS

| | | | |
|---|---|---|---|
| 3438819 | 4/1986 | Fed. Rep. of Germany | 339/103 R |

OTHER PUBLICATIONS

IBM Tech. Disclosure Bulletin, "Cable Shield Termination", Goplen et al, vol. 18, No. 5 (Oct. 1975).

*Primary Examiner*—Eugene F. Desmond
*Assistant Examiner*—David Pirlot
*Attorney, Agent, or Firm*—T. L. Peterson

[57] ABSTRACT

A connecting arrangement comprises a crimp barrel which is crimped against the outer conductor of a coaxial cable and contains a shield wire to be connected to a wrap post of a terminal strip, and a holding device which engages the cable over the edge of the terminal strip board. Two clips are integrally formed on the ends of the holding device. One of the clips clasps the outer diameter of the coaxial cable below the strip board, and the other clip surrounds the insulated inner conductor of the coaxial cable above the strip board.

7 Claims, 3 Drawing Figures

COAXIAL CABLE CONNECTION TO A TERMINAL STRIP

BACKGROUND OF THE INVENTION

This invention relates to coaxial cable connections, and particularly connections of coaxial cables to a terminal strip.

Coaxial cable connections are frequently used in communications equipment. Such connections are commonly made by means of commercially available connecting bends. Such a connecting bend consists of two halves made by pressure die casting, and forms a bent metal tube having a thread lug. After insertion of the prepared coaxial cable, the two halves are put together, their thread lug on the connection side is passed from below through a hole in a terminal strip up to a flange, and the two halves are screwed on the strip board from above by means of an eye nut. In this position, a projection formed integrally on one of the halves of the connecting bend is located at the long side of the board. Mounted in the projection is a wrap post upon which a wire-wrap connection is made to the corresponding wrap post on the strip board.

On the cable-insertion side, the bend is also provided with a threaded connecting portion. As a suitable hexagon nut is screwed on, a grounding sleeve is pressed against the braided shield of the suitably stripped coaxial cable, so that a ground connection is established through the bend and the wrap post to the terminal strip. The end of the stripped inner conductor, which projects from the bend above the terminal strip, is connected directly to the wrap post.

Such connecting bends are expensive. They consist of six different component parts which require relatively complicated and time-consuming assembly operations. In addition, they occupy so much space that only every other hole of the terminal strip can be used.

SUMMARY OF THE INVENTION

The object of the invention is to improve the coaxial-cable connection in such a way that each hole in the terminal strip can be provided with a coaxial cable. This object is attained by a connecting arrangement which comprises a crimp barrel which is crimped against the outer conductor of a coaxial cable and contains a shield wire to be connected to a wrap post of a terminal strip, and a holding device which engages the cable over the edge of the terminal strip board. Two clips are integrally formed on the ends of the holding device. One of the clips clasps the outer diameter of the coaxial cable below the strip board, and the other clip surrounds the insulated inner conductor of the coaxial cable above the strip board.

Such a connection comprises only two different components and a piece of wire. The crimp barrel is an inexpensive, commercially available fastening means and the holding device is a narrow and simple plastic molded component. The parts can be assembled very quickly and compactly, so that cable connections using all holes of the terminal strip can be made in a simple manner and at considerably lower cost than prior art connections.

BRIEF DESCRIPTION OF THE DRAWINGS

An embodiment of the invention will now be explained with reference to the accompanying drawing, in which.

DESCRIPTION OF THE PREFERRED EMBODIMENT

Figure 1:
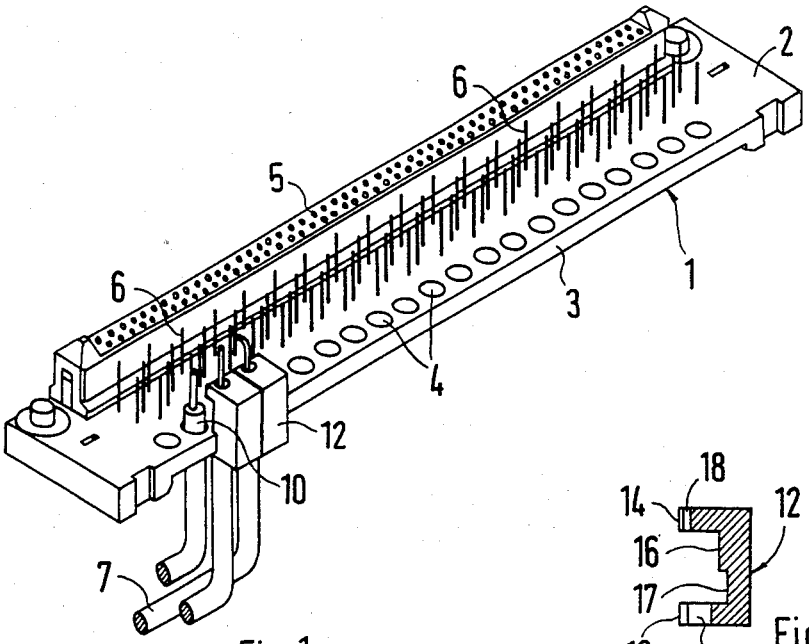
FIG. 1 is a perspective view of a terminal strip with two coaxial cable connections in two adjacent holes.
Figure 3:
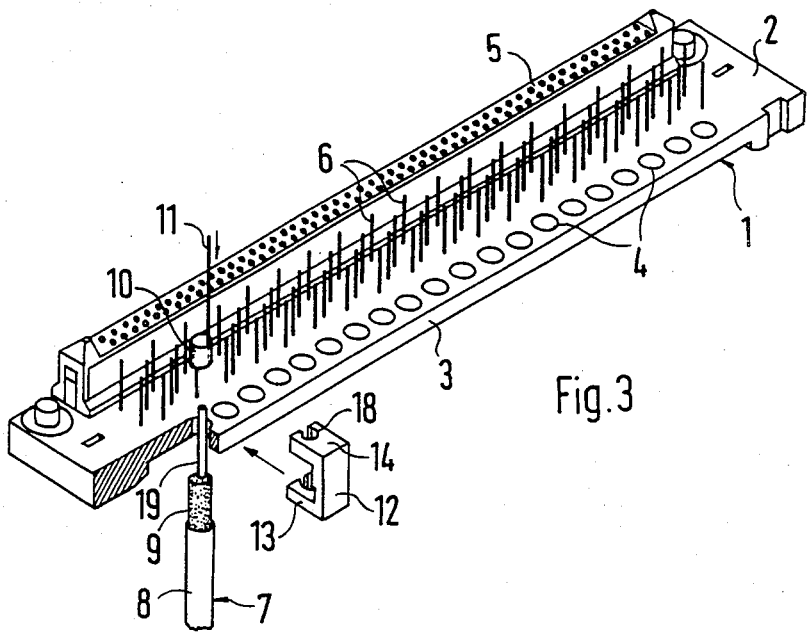
FIG. 3 is an exploded perspective view, partly broken away, of the terminal strip connection of FIG. 1.

As shown in FIGS. 1 and 3, the terminal strip 1 comprises a strip board 2, which is perforated with a row of holes 4 along the edge of side 3, and a contact strip 5 mounted along the edge of the other side, with an array of wrap posts 6 disposed between the contact strip and the row of holes.

To make a connection, a coaxial cable 7 is used which has an outer insulation jacket 8, an outer conductor 9, and an insulated inner conductor 19, each of which has been stripped in a stepped manner as shown in FIG. 3. The end of the stripped outer conductor 9, which is typically a tube of braided wire, carries a crimp barrel 10. The crimp barrel is slipped over the outer conductor 9 together with a shield wire 11 inserted between the outer conductor and the crimp barrel, and is crimped against the outer conductor. The shield wire 11 may alternatively be integral with the crimp barrel or previously be attached by welding or soldering. A portion of the insulated inner conductor 19 projects from the outer conductor. After the coaxial cable, provided with the crimp barrel and the shield wire, has been passed through one of the holes 4 in the terminal strip 1, the end of the cable is fastened to the strip board 2 by means of a holding device 12.

Figure 2:
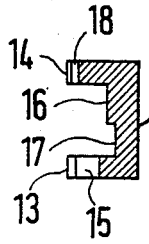
FIG. 2 is a longitudinal sectional view through the holding device (12) as shown in FIG. 1 for fastening a coaxial cable to the terminal strip.

The holding device 12, as shown particularly in FIG. 2, is a one-piece essentially U-shaped plastic molded component having an elastic clip 13 integrally formed at the lower end, and an elastic clip 14 at the upper end. Between the clips 13, 14, there is an inside 16 forming a free space into which the crimp barrel 10 (passed through the hole 4 in the terminal strip 1) projects after the attachment of the holding device. The lower clip 13 has a slotted hole 15 whose diameter is adapted to securely clasp the outer diameter of the coaxial cable 7. Immediately adjacent to this clip 13, the inside of the holding device is provided with a recess 17 adapted in height to the thickness of the terminal board. The upper clip 14, too, has a slotted hole 18 whose diameter is slightly greater than the diameter of the insulated inner conductor 19.

To fasten the coaxial cable to the terminal strip, the cable is first step-stripped and inserted into one of the holes in the terminal strip. The holding device 12 is simply pressed against the strip board 2 with the lower clip 13 snapping over the outer cable jacket 8, and the upper clip 14 snapping over the insulated inner conductor 19, and the strip board engaging the recess 17 of the holding device. The coaxial cable and the holding device are thus fixed in position at the terminal strip 1, and the stripped end of the inner conductor and the shield wire coming from the outer conductor 9 can be wrapped around the respective posts 6. As the holding device needs to be only slightly wider than the diameter of the coaxial cable, all holes 4 of the terminal strip can be occupied by coaxial cables compactly connected by a series of holding devices arranged adjacently along the edge of the strip board.

What is claimed is:

1. A coaxial cable connection for a terminal board having a plurality of holes along the edge thereof and a plurality of wrap posts extending therefrom, comprising:

a coaxial cable having an outer insulation, an outer conductor and an insulated inner conductor step-stripped exposing a portion of the outer conductor, and extending through one of the holes of the terminal board, a crimp barrel adapted to be crimped upon the outer conductor, a shield wire attached to said crimp barrel for connecting the outer conductor to one of the wrap posts of the terminal board, and a holding device, for fixing the coaxial cable into the terminal board, adapted to engage the edge of the terminal board and to extend around the terminal board to clasp the cable.

2. The coaxial cable connection as in claim 1 wherein said holding device comprises a one-piece generally U-shaped component having an elastic clip formed on one end thereof adapted to securely clasp the outer diameter of the cable.

3. The coaxial cable connection as in claim 2 wherein said holding device further comprises a second elastic clip formed on the other end thereof adapted to surround the insulated inner conductor of the cable.

4. The coaxial cable connection as in claim 3 wherein said holding device further comprises an inside surface between said elastic clip and said second elastic clip having a recess corresponding in height to the thickness of the terminal board.

5. A holding device for securing a coaxial cable having an outer insulation layer, an outer conductor layer, and an insulated inner conductor layer with each layer step-stripped for connection into a terminal board having a plurality of holes along one edge of the board, comprising:

a one-piece generally U-shaped component having a lower elastic clip formed on one end thereof adapted to securely clasp the outer diameter of the outer insulation layer of the cable, an upper elastic clip formed on the other end thereof adapted to surround the insulated inner conductor layer of the cable, and an inner surface between said lower clip and said upper clip having a recess therein adapted to engage the edge of the board.

6. The holding device as in claim 5 wherein said device is a molded insulative body.

7. The holding device as in claim 5 wherein said device is only slightly wider than the diameter of the coaxial cable to permit close spacing of adjacent cables.

* * * * *